United States Patent [19]

Fragale

[11] Patent Number: 4,496,265

[45] Date of Patent: Jan. 29, 1985

[54] COMPACT ASPHALT LAYING MACHINE FOR SIDEWALKS AND THE LIKE

[76] Inventor: Joseph V. Fragale, 93 Chestnut Hill Rd., Torrington, Conn. 06790

[21] Appl. No.: 461,941

[22] Filed: Jan. 28, 1983

[51] Int. Cl.[3] ..... E01C 19/18

[52] U.S. Cl. ..... 404/110; 404/118; 404/96

[58] Field of Search ..... 404/108, 109, 110, 101, 404/118, 96; 414/346; 280/112 A; 37/117.5, 118 R, 126 AA

[56] References Cited

U.S. PATENT DOCUMENTS

| | | | |
|---|---|---|---|
| 1,393,341 | 10/1921 | Bower | 404/110 |
| 2,094,910 | 10/1937 | Baily | 404/96 |
| 2,590,443 | 3/1952 | Miller | 404/110 |
| 2,890,632 | 6/1959 | Madison et al. | 404/96 |
| 2,953,977 | 9/1960 | Warren | 404/110 |
| 3,108,517 | 10/1963 | Fingland | 404/110 |
| 3,213,769 | 10/1965 | Smith | 404/110 |
| 3,288,041 | 11/1966 | Layton | 404/108 |
| 3,482,494 | 12/1969 | Jennings, Jr. | 404/110 |
| 3,526,173 | 9/1970 | Brandstetter et al. | 404/108 |
| 3,792,748 | 2/1974 | Regier | 280/112 A X |
| 3,977,693 | 8/1976 | Gamaunt | 280/112 A X |
| 4,063,361 | 12/1977 | Hyler et al. | 280/112 A X |
| 4,102,590 | 7/1978 | Zanzie | 404/110 |
| 4,357,129 | 11/1982 | Luttig | 414/346 |

*Primary Examiner*—Stephen J. Novosad
*Assistant Examiner*—Beverly E. Hjorth

[57] ABSTRACT

A self-propelled paving machine has a pivotable steering assembly, a gravity-fed hopper, and is relatively small, thereby specifically adapting it to applications in which high degrees of maneuverability are required, such as for paving sidewalks, golf cartways, and the like. The hopper is designed to permit loading from either side using a wheelbarrow, thus contributing to the suitability of the machine for small paving jobs, and the screed assembly is readily and conveniently adjusted to vary the thickness, width, and configuration of the deposited mat.

5 Claims, 11 Drawing Figures

COMPACT ASPHALT LAYING MACHINE FOR SIDEWALKS AND THE LIKE

BACKGROUND OF THE INVENTION

There presently exists a considerable demand for a machine that is especially adapted for paving areas that are relatively narrow, and for use over surfaces that are rough and/or irregular, such as sidewalks, golf course paths, gutters, and the like. Road surfaces are normally paved using machines that are designed to receive, distribute, discharge and form wide carpets of the material, typical of which are those described in Potts U.S. Pat. No. 3,550,511, and Schraeder U.S. Pat. No. 3,992,124. Such machines are relatively large and complex, and lack appropriate capability and the maneuverability necessary to carry out, in a practical way, jobs of the foregoing nature.

Curb forming machines are described in U.S. Pat. Nos. 2,707,422; 2,818,790; 3,053,156; 3,115,074, 3,175,478; 3,261,272; and 3,915,584. Although such machines tend to be considerably smaller, less cumbersome, and more maneuverable than the road carpeting machines, they are not generally suited for manual loading (such as from a wheelbarrow), they do not lend themselves to facile transport from one job site to another, and they normally require augers or other distributing means; moreover, the curb-laying machines are not, of course, generally useful for paving applications.

Devices known as "drag boxes" are in common use for laying carpets or mats of paving material. These entail the disadvantage of requiring separate propulsion means; furthermore, they are usually relatively large and cumbersome, they are not adapted for loading by manual means, and they do not readily lend themselves to direct control by the machine operator.

Accordingly, it is a primary object of the present invention to provide a novel, self-propelled machine for laying narrow mats of asphalt and similar materials over rough and/or irregular terrain, which machine is relatively small and maneuverable, to permit paving of difficult-to-reach locations.

It is a more specific object of the invention to provide such a machine in which no augers or other powered devices are required for delivery or distribution of the paving material to the ground surface, and which can be loaded from either side by use of a wheelbarrow.

Another object of the invention is to provide a machine of the foregoing nature in which adjustments can readily be made by the operator, either during paving operations or when the machine is idle, to change the width and/or the thickness of the mat.

A further object of the invention is to provide such a machine having the foregoing features and advantages, which is relatively uncomplicated and inexpensive to manufacture, and is highly convenient and facile to use.

SUMMARY OF THE INVENTION

It has now been found that the foregoing and related objects of the invention are readily attained in a self-propelled paving machine comprising, in combination, a wheel-mounted body, drive means for propelling the machine, a gravity-fed hopper, and a screed assembly. The body is comprised of a main body portion and a steering assembly, the latter being attached forwardly of the main body portion for relative pivotable movement about a longitudinal axis; the drive means is mounted on the main body portion. The hopper is mounted rearwardly on the body, and it has forward, rearward and side wall components and a transverse discharge opening extending across its bottom portion. Upper edge portions of the forward and rearward walls of the hopper lie substantially on a common plane, and the side wall components are indented downwardly therefrom to provide areas on both sides of the hopper for wheelbarrow access and loading. A panel is disengageably mounted on each of the side walls of the hopper to close the access area thereof, and to provide upper edge portions lying substantially on the common plane. The screed assembly is mounted at the rear of the hopper for pivotable movement about a transverse axis, and is positioned behind the discharge opening to form the paving material as it is deposited from the machine.

DETAILED DESCRIPTION OF THE ILLUSTRATED EMBODIMENTS

Figure 1:
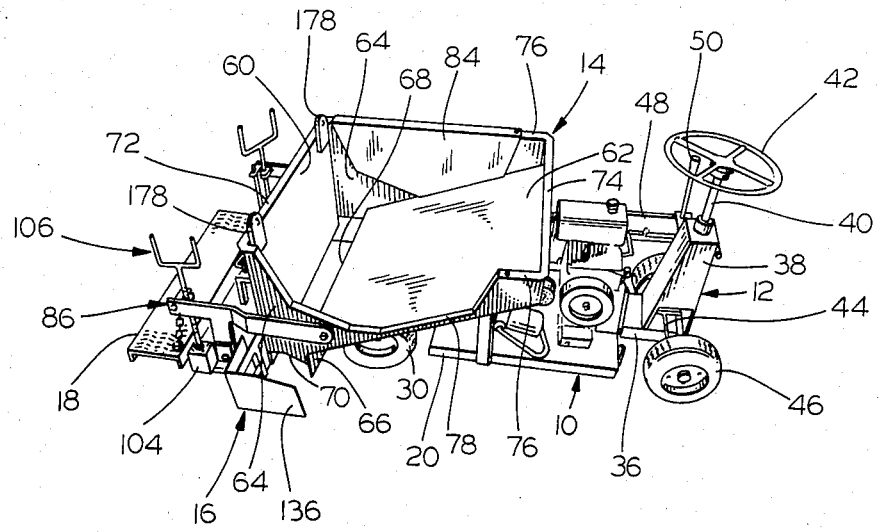
FIG. 1 is a side perspective view of a machine embodying the present invention, with the near side wall panel of the hopper removed.
Figure 2:
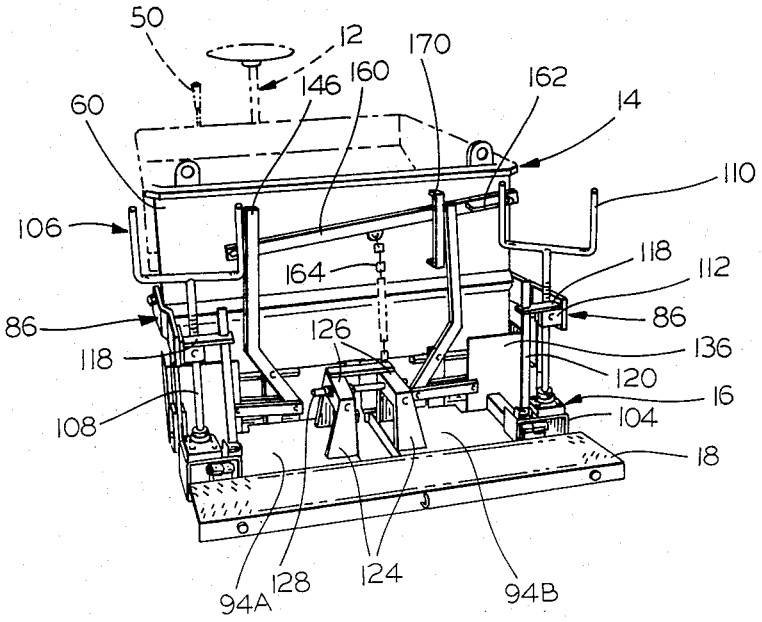
FIG. 2 is a rear perspective view of the machine of FIG. 1, with forward portions shown in phantom line.
Figure 3:
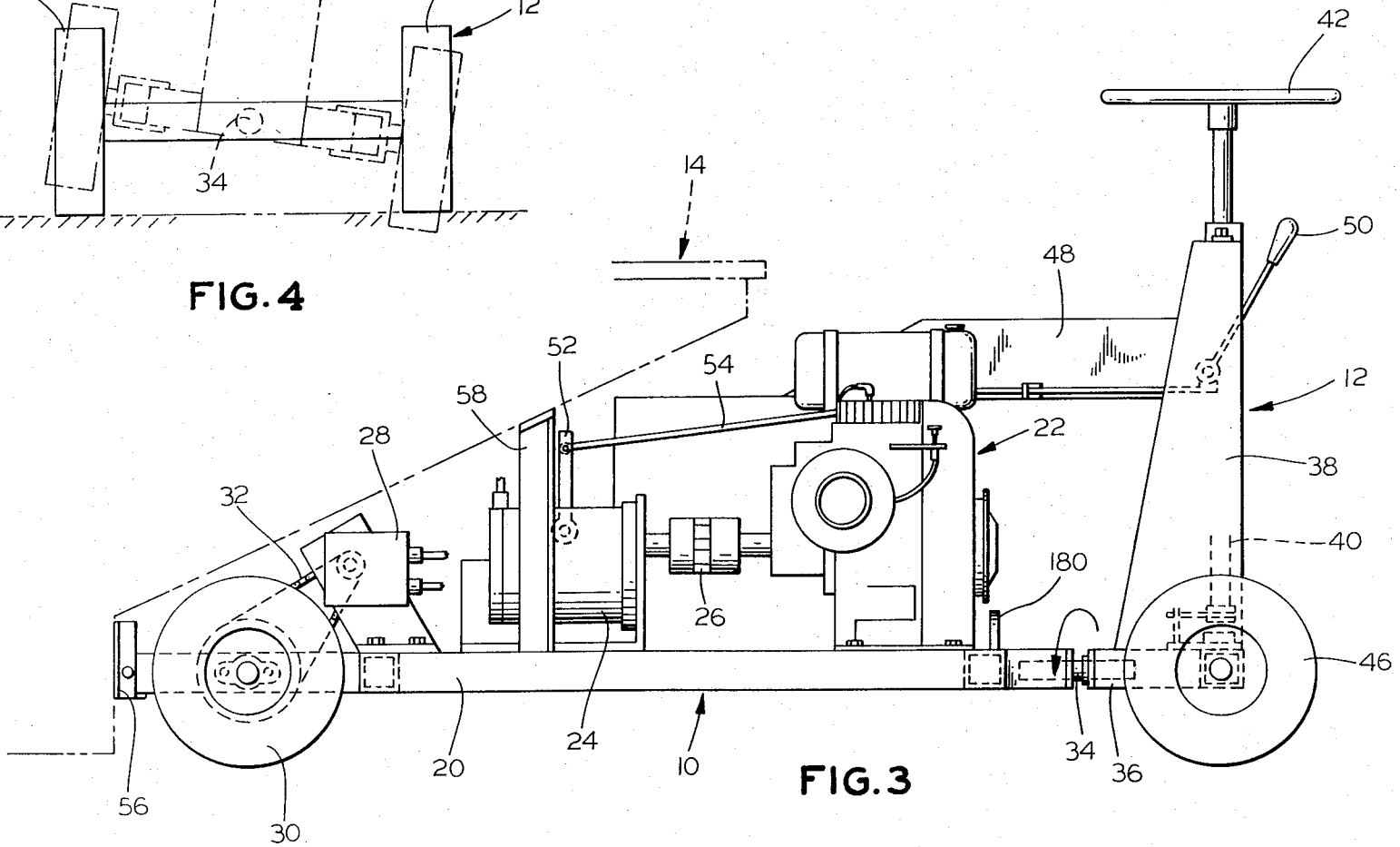
FIG. 3 is a fragmentary side elevational view of the machine of the foregoing Figures, drawn to a greatly enlarged scale and showing the hopper and rear wheels in phantom line.
Figure 4:
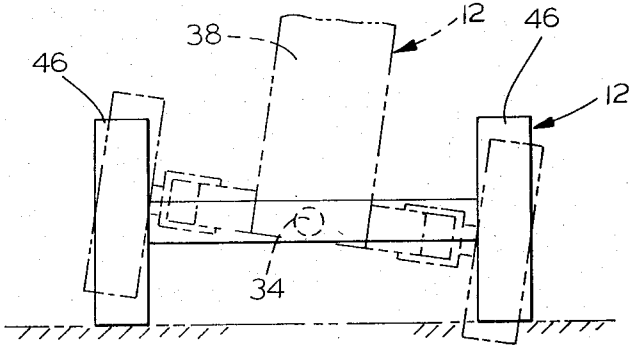
FIG. 4 is a schematic fragmentary view of the machine, taken from the front thereof and showing, in full and phantom line, respectively, level and titled orientations of its front end.

As seen in FIGS. 1 and 2 of the appended drawings, the machine of the invention consists of a main body portion, generally designated by the numeral 10, a steering mechanism, generally designated by the numeral 12, a hopper, generally designated by the numeral 14, a screed assembly, generally designated by the numeral 16, and a catwalk 18, which is hingedly attached to the screed assembly 16. The chassis 20 of the machine is constructed from box-stock, and an internal combustion engine, generally designated by the numeral 22, is mounted (with its associated gas tank and other components) on the main body portion 10. The engine 22 is connected to the shaft of a hydraulic pump 24 through a universal joint 26, which is, in turn, connected by suitable lines to the pump motor 28, by which the rear wheels 30 are driven through a suitable chain 32.

Figure 9:
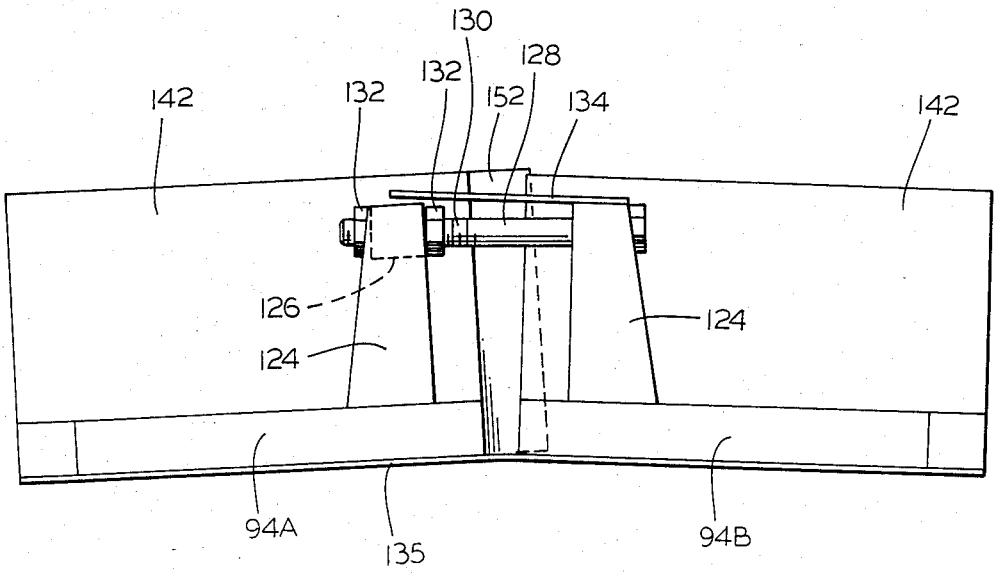
FIG. 9 is a rear end view of the means by which the screed plate is adjusted for modification of the mat crown configuration.

The steering assembly 12 is attached to the main body portion 10 by a shaft 34, which extends outwardly from the chassis 20 along the longitudinal axis of the machine. Means is provided to engage the shaft 34 within the chassis portion 36 of the steering assembly 12 so as to permit the latter to pivot about its axis. This feature is illustrated in FIG. 9, wherein tilted and level orientations of the steering assembly 12 are depicted, respectively, in phantom and full line. As will be appreciated, the ability of the steering mechanism to freely pivot relative to the main body portion will enable operation of the machine over irregular or undulating surfaces, without allowing changes in the attitude of the steering mechanism to affect the mat deposited from the hopper 14; orientation of the hopper will instead be controlled by the rear wheels 30, more truly following the contours of the terrain due to the proximity therebetween.

The steering assembly 12 includes an upright housing portion 38 supported on the chassis portion 36, through which extends the column 40 of a steering wheel 42, and the lower end of the column 40 is connected to the front wheels 46 by rods 44. A bracket 48 is secured to the main body portion 10, and projects forwardly to the location of the steering wheel 42. It supports an operating handle 50, which is attached through appropriate linkages 54 to the control lever 52 of the hydraulic pump 24. By moving the handle 50 forwardly, rearwardly, and to a neutral position the machine can be made to operate in either a forward or reverse direction, or to remain idle.

The hopper 14 is attached to the main body portion 10 of the machine by bolting it to rear brackets 56 and to the top of the upstanding support posts 58, which are in turn secured to the chassis 20. The construction of the hopper itself is best shown in FIG. 1, from which it can be seen to consist of a generally vertical rear wall 60, an inclined forward wall 62, and vertical side wall members 64 extending therebetween. The front wall 62 has a short skirt portion 66 extending transversely across its lower edge, which cooperates with the lower edge portion of the rear wall 60 to define a narrow discharge channel 68; the adjacent lower portions of the side wall members 64 are upwardly recessed at 70, to permit outward movement of the material therethrough.

Figure 10:
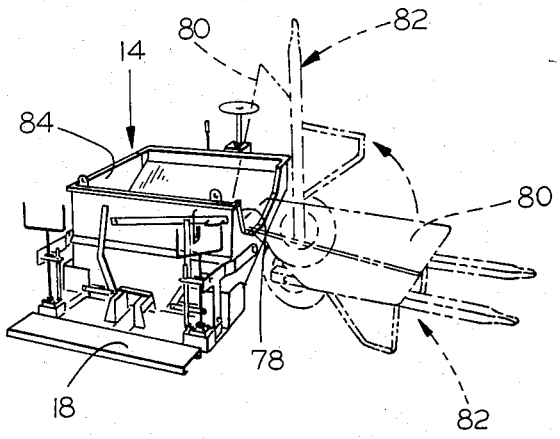
FIG. 10 is a perspective view showing the use of a wheelbarrow to load the hopper of the machine.
Figure 11:
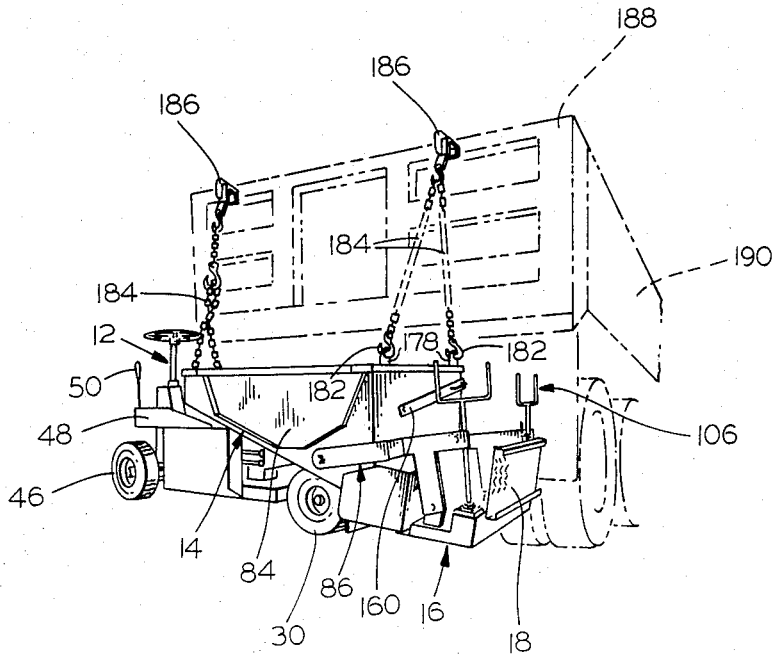
FIG. 11 is a perspective view depicting the machine supported on the tailgate of a truck, for transport from place-to-place.

A unique feature of the hopper 14 resides in the configuration of the side wall members 64. As will be noted, the upper edge portions 72, 74 of the rear wall 60 and the forward wall 62, respectively, lie on a common plane, which will generally be horizontal when the machine itself is level. The upper edges of the side wall members 64 include elements 76 adjacent to the edge 74 of the forward wall 62, which also lie on the common plane but which descend therefrom. The adjacent elements 76 extend progressively downwardly and then upwardly to the level of the edge 72, thereby defining a generally U-shaped indentation 78 in each of the side walls 64. As seen in FIG. 10, this provides an access area to receive the forward end of the body 80 of a wheelbarrow, generally designated by the numeral 82, which can then be pivoted to empty its contents into the hopper 14.

A panel 84 is provided to close each indentation 78, and is designed for disengageable mounting therein by suitable means; for example, interfitting parts may be furnished on the side wall 64 and the panel 84, with appropriate fasteners being used to secure the panel 84 in place. Thus, removal of either panel will permit loading of the hopper 14 from that side, contributing substantially to the convenience and facility of operation. Alternately, the hopper can of course be filled directly with a conventional curbfeeder, in which case both of the panels 84 would be left in place.

Figure 5:
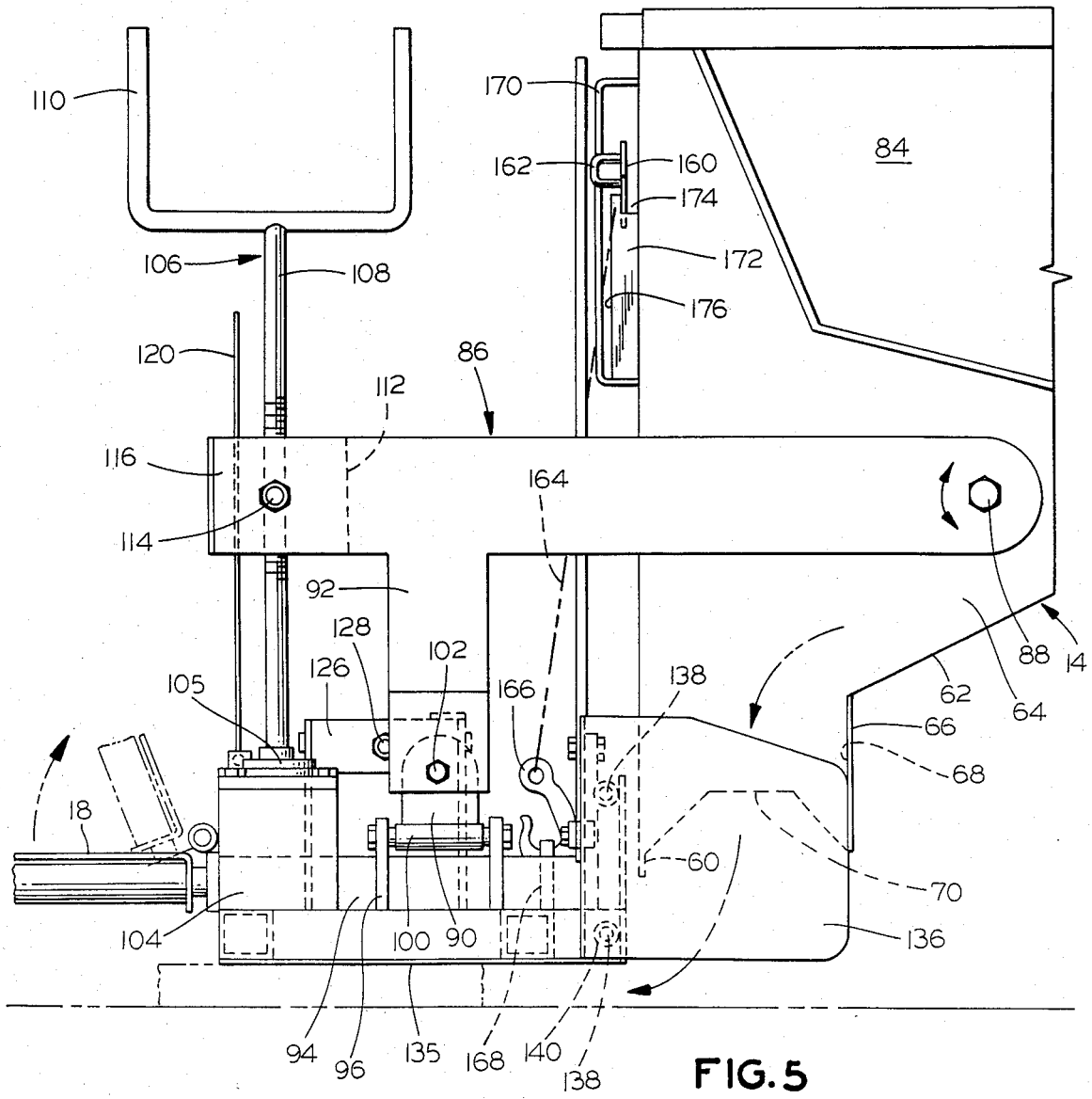
FIG. 5 is a fragmentary side elevational view of the rear portion of the machine, drawn to a scale that is greatly enlarged from that of FIGS. 1 and 2.

A T-shaped arm, generally designated by the numeral 86, has a bolt 88 fastening it to each side wall 64 of the hopper 14, the bolts 88 providing points at which the arms 86 pivot about a transverse axis, as indicated by the double-headed arrow in FIG. 5. Hinge plates 90 are fastened by bolts 102 adjacent the free ends of the depending elements 92 of the arms 86, thereby supporting the screed platform 94, through connection to ears or tabs 96 thereon. Attachment of the tabs 96 is achieved by use of bolts 98, each of which extends through an aperture in the tab and through the aligned passage of the curled portion 100 of the plate 90. Thus, the platform 94 is capable of being pitched forwardly and rearwardly (i.e., longitudinally) about the bolts 102, as well from side-to-side (i.e., laterally) about the perpendicular axes of the bolts 98.

A mounting piece 104 of inverted, U-shaped cross-section is secured at each of the rear-most corners of the screed platform 94, and has mounted upon its upper surface a universal bearing support fixture 105. Each fixture receives the end portion of a jacking member, generally designated by the numeral 106, which consists of a threaded shaft 108 and a U-shaped handle portion 110; the universal fixtures 105 mount the jacking members 106 for free rotation and pivotable movement therein.

A block 112 is pivotably attached by the bolt 114 adjacent the free end of the rearwardly extending element 116 of each pivot arm 86, and has a threaded aperture (not visible) in which the shaft 108 of the jacking member 106 is engaged. Thus, rotation of the handle 110 will cause the arm 86 to pivot in a generally upward or downward direction about the connecting bolt 88, depending of course upon the direction in which the handle is rotated. This will, in turn, cause the platform 94 of the screed assembly 16 to pivot about the connecting bolts 102, thereby effecting changes in the longitudinal pitch of the platform 94, as can best be seen by comparing the illustrations of FIGS. 5 and 7. In the latter Figure the jacking device 106 has been adjusted to increase (as compared to FIG. 5) the separation between the attached end of the arm 86 and the support piece 104, causing the platform 94 to pitch slightly upwardly. Lateral pitch of the screed can be changed in a similar manner, merely by adjusting the two jacking members 106 to position the sides of the screed at different levels.

To facilitate such pitch adjustments a level indicator bar 118 (best seen in FIGS. 2 and 6) is affixed to each of the adjusting blocks 112 to extend laterally inwardly therefrom. An upstanding rule 120, marked with a height-indicating scale, is pivotably attached to the top surface of each U-shaped mounting piece 104 and is received in the slot 122 of the corresponding bar 118. The relative positions of the opposite sides of the platform 94 can readily be determined by reference to the scales on rules 120, affording an indication of both the lateral and also the longitudinal pitch of the screed assembly.

As is conventional in paving machines, the screed platform 94 can also be configured to form a crown or an invert (depression) along the length of the pavement, either to promote water runoff (as for a walkway) or to channel water flow (as for a trench or gutter), respectively. The platform 94 is divided into two lateral sections 94A, 94B, each of which has a pair of upstanding supports 124 affixed its inner margin, with a crosspiece 126 extending longitudinally therebetween. An elongated bolt 128 passes between the parallel crosspieces 126; it carries a nut 132 on each side of the crosspiece that receives the threaded end 130 and is affixed to the other crosspiece, enabling the spacing between the crosspieces 126 to be increased or decreased by adjusting the nuts 132. As depicted in FIG. 9, the bolt 128 has been so set as to produce a transverse concavity in the forming plate 135, which is secured across the sections 94A, 94B, thus configuring it to form a crown in the mat of paving material. Adjusting the nuts 132 to decrease the separation between the crosspieces 126 will first cause the plate 134 to assume a planar condition, and will thereafter induce a transverse convexity in it, thereby adapting the screed to form an invert, or shallow depression, along the length of the deposit.

Figure 6:
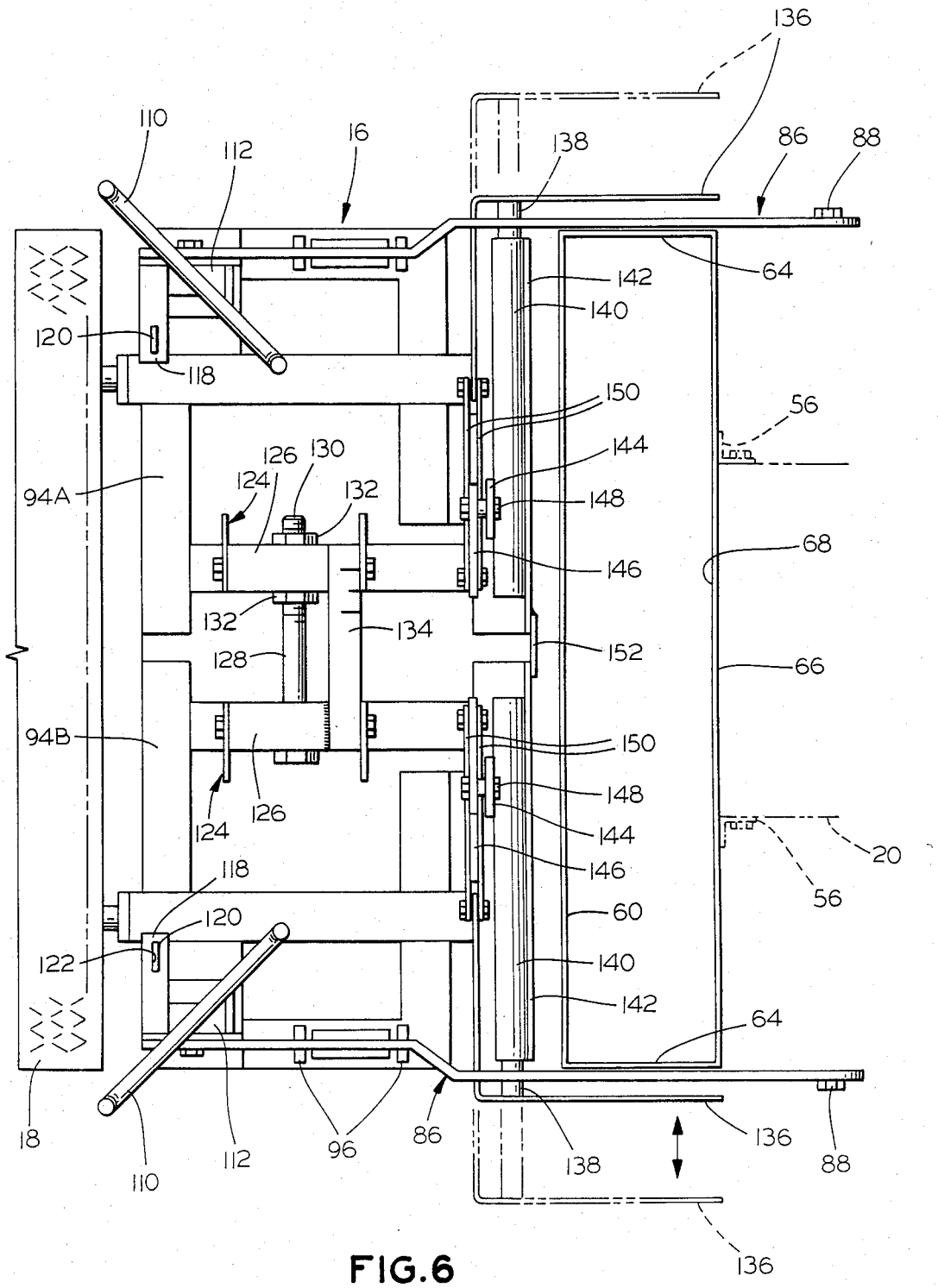
FIG. 6 is a top plan view of the portion of the machine of FIG. 5 showing the lower part of the hopper, and showing alternate positions of the mat width controlling mechanisms in full and phantom line.

As can best be seen in FIG. 6, a short graduated bar 134 extends from one crosspiece 126 to the other, to serve as an indicator of the forming plate arch. In the position shown in FIG. 6 a neutral (i.e., level) condition is depicted; adjustment to align the outer mark with the inner edge of the underlying crosspiece 126 indicates a positive arch, or crown (as illustrated in FIG. 9), and alignment of the mark at the opposite end of the scale indicates a negative arch, or invert.

Figure 8:
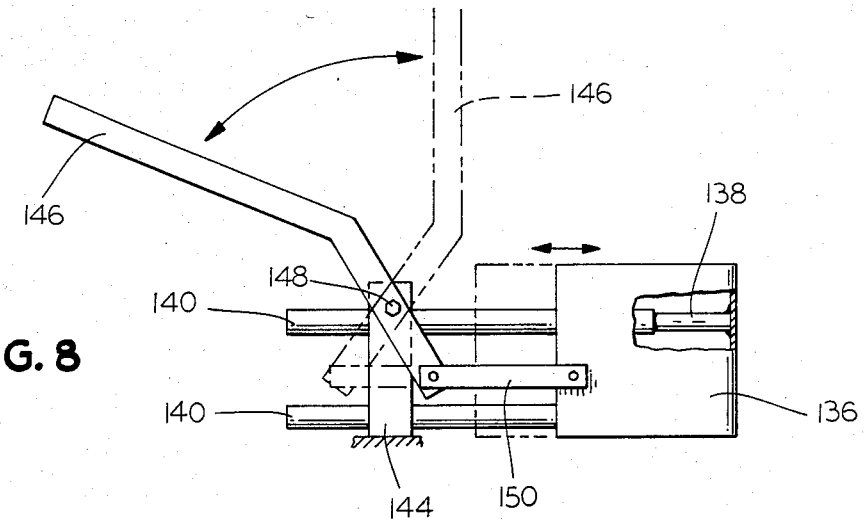
FIG. 8 is a fragmentary rear view showing, in full and phantom line, two alternative positions of the width controlling mechanism, with a section broken away to expose the guide means for the side panel.

The screed width adjusters, which are provided on both sides of the machine, are illustrated in greatest detail in FIG. 8 of the drawings. Each adjuster consists of a right-angle panel 136 having a pair of vertically aligned parallel rods 138 (only one of which is visible in this Figure) extending laterally from the inside surface of the outer portion thereof. The rods 138 are, in turn, received in parallel tubes or pipes 140, which are welded to the upstanding forward plate 142 on the corresponding platform section 94A, 94B. A mounting post 144 is fixed in an upright position to the pipes 140, and pivotably mounts an operating handle 146 adjacent its upper end; bolt 148 provides the pivot point, and parallel links 150 connect the lower end of the handle 146 to the inner margin of the panel 136. As will be evident, movement of the handle 146 from the full line position to the phantom line position of FIG. 8 will shift the panel 136 from its fully extended to its fully retracted positions, respectively, with the parallel rods 139 sliding within the tubes 140, thus securely mounting the angle panel 136, guiding its movement, and maintaining its proper orientation.

As is best seen in FIGS. 6 and 9, the upstanding plate 142 on the screed platform section 94A has a marginal strip 152 affixed along its inside edge, the strip 152 being sufficiently wide to cause it to span the gap between the inner margins of the two plates 142, thereby closing the same. This prevents the entry of paving material between the upstanding plates, regardless of the attitude in which the sections 94A, 94B are disposed.

Figure 7:
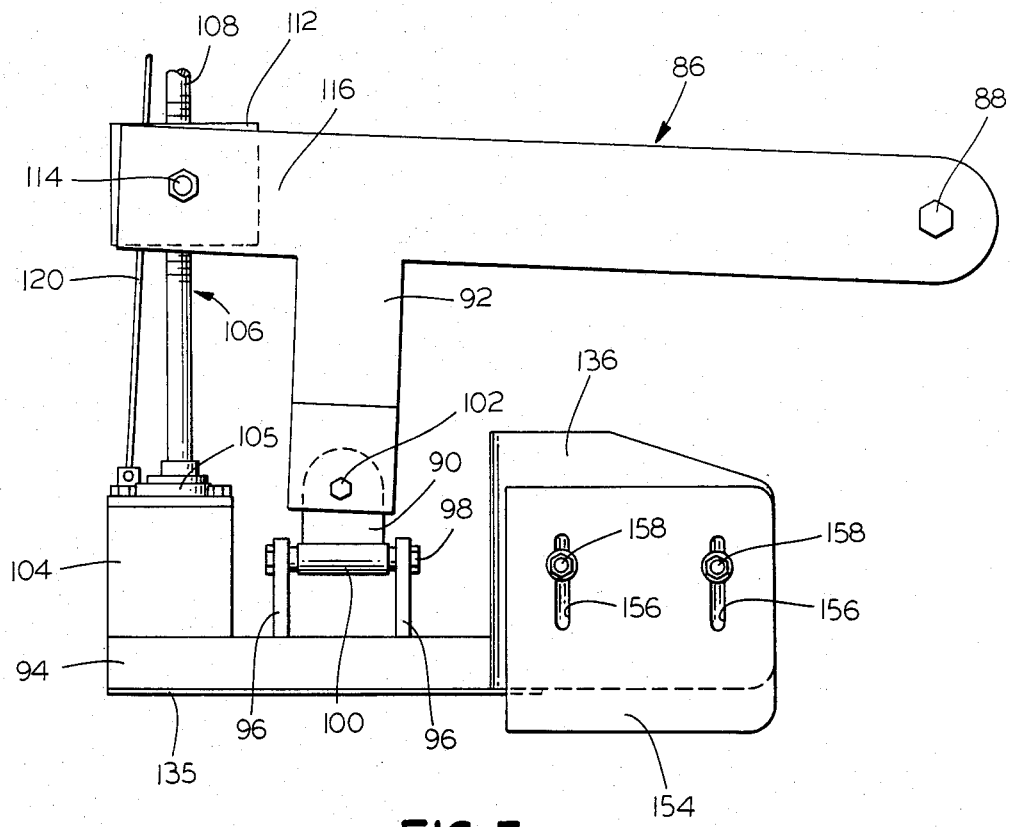
FIG. 7 is a fragmentary side elevational view of portions of the screed assembly, as modified by the provision of an adjustable plate on the end panel of the width controlling mechanism.

FIG. 7 depicts a desirable modification of the screed assembly, wherein a control plate 154 is mounted on each right-angle panel 136 of the two width adjusters. As can be seen, the illustrated plate 154 has a pair of parallel, normally vertical slots 156 formed through it, in which are received the bolts 158, the latter projecting outwardly from the side portion of the panel 136. The plate 154 can therefore be adjusted to just above ground level and secured in position by tightening the nuts on the bolts 158; this will produce well-defined margins on the asphalt mat by preventing the outward flow of paving material therebeyond.

With reference now to FIGS. 2 and 5, it can be seen that the entire screed assembly 16 can be elevated from the ground by operation of the generally horizontal lever 160, which is pivotably attached to the rear wall 60 of the hopper 14 at one end, and has a handle portion 162 at its opposite end. Chain 164 is attached intermediate the ends of the lever 160 and has a hook 166 attached to its lower end, which is received through the aperture of a plate 168 attached to the frame of the screed assembly. A C-shaped guide piece 170 is secured to the wall 60 about the handle 160, and a notched latching plate 172 is affixed thereto within the piece 170. In the position shown, the handle 160 resides within the notch 174 of the latching plate 172, thereby maintaining the screed assembly 16 (by connection through the chain 164) off the ground. As will be evident, the assembly can be lowered merely by lifting the handle 160 out of the notch 174 and permitting it to descend within the channel 176 between the guide piece 170 and the latching plate 172.

As is best seen in FIGS. 1–3 and 11, two upstanding tabs 178 are attached to the inside surface of the rear wall 60 of the hopper 14 along its upper edge 72, and two similar tabs 180 (only one of which is visible in FIG. 3) are attached to the chassis 20 of the main body portion 10. The tabs 178, 180 have apertures formed through them, in which are received the hooks 182 that are provided on the ends of the chains 184; C-shaped brackets 186 are attached to the opposite ends of the chains 184, and are engaged over the upper edge of the tailgate 188 of a dump truck body 190. As will be appreciated, elevating the bed 190 in the usual fashion will lower the tailgate, permitting the hooks 186 to be placed thereover with the machine on the ground. Lowering the truck bed 190 will lift the machine, so that it can be conveniently transported while suspended from the rear of the truck.

At the commencement of operation, and once the machine is moved (under its own power) to the desired location, a pair of spacer blocks (such as of 2×4 board) are positioned beneath the screed assembly 16, which is lowered thereonto by releasing the handle 160 from the latching plate 172. With the screed assembly resting on the blocks a volume of paving material is discharged, the depth of the deposit being established by the height of the blocks. This depth will be maintained after the machine has started forwardly and until some adjustment is made in the pitch of the screed, through operation of the jacking members 106. The width of the mat will, of course, be determined by the position of the right-angle panels 136.

The path over which the machine is to traverse is controlled by an operator walking in front of the machine and steering it as appropriate. In that position, he can also operate the direction lever 150, and can observe both sides of the machine to determine that the deposit of paving material, as it flows through the channel 68, is of the proper width and thickness. A second person may "ride" on the catwalk 18 at the rear of the machine, from which position he can readily change the width and thickness of the mat by operation of the appropriate controls. He can also assist in emptying and distribution of the paving material into and within the hopper.

If the machine is to be fed by a wheelbarrow, either the left or right side hopper panel will be removed; both panels will normally remain in place if loading is to be done using a curbfeeder. Once the hopper is filled, the direction handle is positioned to drive the machine forwardly. An operator can regulate the screed pitch adjusters to any desired height, by turning the jacking members in the proper direction. If a crown or invert is required in the mat he can make suitable adjustments, and the width adjusters can be positioned to regulate the width of the mat, normally within a range of from three to four feet. All such changes can be carried out either while the machine is at idle or is in operation.

Once the machine has reached the end of the desired paving area, the screed assembly is elevated by lifting the handle, enabling it to be maneuvered into position for the next pass. The front end of the machine is capable of articulating on uneven ground, allowing it to achieve access to many hard to reach areas, and the free-floating design of the screed simplifies the maintenance of a uniform grade. The operator has full view of both sides of the machine while it is in motion, making it easier to pave "tight" curves and circles.

Thus, it can be seen that the present invention provides a novel machine for laying narrow mats of asphalt and other paving materials over rough and/or uneven terrain, which machine is self-propelled and is relatively small and maneuverable, to permit paving of hard to reach places. The invention provides a machine in which no augers or other powered devices are required for delivery or distribution of the paving material to ground surfaces, and it can be loaded from either side, preferably by use of a wheelbarrow. The invention also provides a machine in which adjustments can readily be made by the operator, either during paving operations or when the machine is idle, to change the width, the thickness and/or the configuration of the mat; the machine is relatively uncomplicated and inexpensive to manufacture, and is highly convenient and facile to use.

Having thus described the invention, what is claimed is:

1. In a self-propelled paving machine, the combination including:

A. a wheel-mounted body comprised of (1) a main body portion, and (2) a steering assembly disposed forwardly of said main body portion and comprising a first pair of laterally aligned wheels, said assembly including means for permitting independent pivotable movement of said first pair of wheels relative to said main body portion about a longitudinal axis;

B. drive means mounted on said main body portion for propelling said machine;

C. a gravity-fed hopper mounted in fixed position on said main body portion, said hopper having forward, rearward and sidewall components and a transversely extending discharge opening in the bottom portion thereof, the upper edge portions of said forward and rearward components lying substantially on a common plane, and the sidewall components thereof being indented downwardly from said plane to provide areas on both sides of said hopper dimensioned and configured to provide access and support for wheelbarrow loading, said hopper also having a panel disengageably mounted on each of said sidewall components closing said access area thereof and providing upper edge portions lying substantially on said common plane;

D. a second pair of wheels transversely aligned on said main body portion and positioned beneath said hopper in close proximity to said discharge opening thereof, said wheels being operatively connected to said drive means; and E. a screed assembly mounted at the rear of said hopper for pivotable movement about a transverse axis therethrough, said screed assembly lying substantially behind said discharge opening and having a member for forming the paving material as it is discharged from said machine.

2. The machine of claim 1 wherein said screed assembly has means associated therewith for adjusting its pitch, the lateral configuration of its forming member, and its effective width, said adjusting means being conveniently accessible from one position at the rear of said machine.

3. The machine of claim 2 wherein means is provided for elevating the entire screed assembly from ground level, said elevating means also being conveniently accessible from said position.

4. The machine of claim 1 wherein engagement portions are provided thereon for receiving means for suspending said machine from an overlying support, said engagement portions permitting attachment of chains or like members, whereby said machine can be elevated and transported from a truck or similar vehicle.

5. In a self-propelled paving machine, the combination including:

A. a wheel-mounted body comprised of (1) a main body portion, and (2) a separate articulated steering assembly disposed forwardly of said main body portion and comprising a first pair of laterally aligned wheels, said assembly including means for connecting said assembly to said main body portion and disposed generally on a longitudinal axis therebetween, said connecting means permitting independent pivotable movement of said assembly relative to said main body portion generally about said longitudinal axis;

B. drive means mounted on said main body portion for propelling said machine;

C. a gravity-fed hopper mounted in fixed position on said main body portion, said hopper having forward, rearward and sidewall components and a transversely extending discharge opening in the bottom portion thereof, the upper edge portions of said forward and rearward components lying substantially on a common plane, and the sidewall components thereof being indented downwardly from said plane to provide areas on both sides of said hopper dimensioned and configured to provide access and support for wheelbarrow loading, said hopper also having a panel disengageably mounted on each of said sidewall components closing said access area thereof and providing upper edge portions lying substantially on said common plane;

D. a second pair of wheels transversely aligned on said main body portion and positioned beneath said hopper in close proximity to said discharge opening thereof, said wheels being operatively connected to said drive means; and E. a screed assembly mounted at the rear of said hopper for pivotable movement about a transverse axis therethrough, said screed assembly lying substantially behind said discharge opening and having a member for forming the paving material as it is discharged from said machine.

* * * * *